United States Patent [19]

Petaja et al.

[11] 4,344,478

[45] Aug. 17, 1982

[54] HEAT EXCHANGE APPARATUS

[75] Inventors: Glen E. Petaja; Charles E. Cedar, both of Hibbing, Minn.

[73] Assignee: L & M Radiator, Inc., Hibbing, Minn.

[21] Appl. No.: 174,159

[22] Filed: Jul. 31, 1980

[51] Int. Cl.[3] ..... F28F 9/06

[52] U.S. Cl. ..... 165/69; 165/76; 165/175

[58] Field of Search ..... 165/76, 69, 173, 175

[56] References Cited

U.S. PATENT DOCUMENTS

| | | | |
|---|---|---|---|
| 1,416,337 | 5/1922 | Deane | 165/76 |
| 2,816,739 | 12/1957 | Stoehr | 165/76 |
| 3,324,942 | 6/1967 | Miller | 165/76 |
| 3,391,732 | 7/1968 | Murray | 165/76 |
| 3,750,744 | 8/1973 | Bouras | 165/76 |
| 4,236,577 | 12/1980 | Neudeck | 165/175 |

*Primary Examiner*—Sheldon J. Richter

*Attorney, Agent, or Firm*—Allegretti, Newitt, Witcoff & McAndrews

[57] ABSTRACT

An improved heat exchange apparatus useful for cooling hot oil generated through the operation of industrial machinery. The improved apparatus has a support member, at least one heat exchange tube secured at each end to the support member, and an elongated heat exchange tube retainer. The central portion of the heat exchange tube has at least one heat exchange fin extending outwardly from the periphery of the tube. The heat exchange tube retainer is mounted on a heat exchange tube end portion to hold the heat exchange tube firmly in place within the support member and preferably, although not necessarily, has at least one protruding portion that deflects air towards the heat exchange fin extending from the heat exchange tube retainer to enhance the heat exchange effectiveness of the apparatus.

21 Claims, 10 Drawing Figures

HEAT EXCHANGE APPARATUS

BACKGROUND OF THE INVENTION

This invention relates to an improved heat exchange apparatus, particularly of the type used to cool hot oil generated through the use of industrial machinery. More particularly, the invention concerns a heat exchange apparatus, for which heat exchange air flows past heat exchange tubes, employing a novel heat exchange tube retainer to hold the heat exchange tubes firmly in place and preferably, although not necessarily, deflect air toward heat exchange fins on the heat exchange tubes.

A typical heat exchange apparatus includes a support member and several heat exchange tubes with heat exchange fins attached to and surrounding the periphery of the central portion of the tubes. Each of the tubes are supported at each end within the support member. The support member is generally a preconstructed rectangular frame with apertures in two opposing sides within which the heat exchange tubes are inserted during assembly. The heat exchange tubes are sometimes secured within the apertures of the support member by welding the ends of the tubes within the apertures. Other methods of securing the tubes within the support member, such as force fitting the tubes into grommeted frame apertures, allow for later removal of the heat exchange tubes from the frame for repair, replacement, or cleaning. Representative of prior art heat exchange apparatus having removable heat exchange tubes is Murray U.S. Pat. No. 3,391,732. Such constructions of the prior apparatus have certain deficiencies, however.

For example, in order to insert the heat exchange tubes into the apertures within the preconstructed frame, the axial length of the central finned portion of the heat exchange tubes must be substantially shorter than the distance between the apertures within which the tube is mounted. After assembly of the apparatus, there is, therefore, a sizable portion of the tube within the inside perimeter of the frame which is not surrounded by a heat exchange fin. These non-finned portions of the heat exchange tubes not only serve little or no heat exchanging function but also become paths of at least resistance for air flow through the apparatus. Air which would otherwise remove heat by passing through a finned portion of a heat exchange tube thus escapes through the non-finned portion, decreasing the overall heat exchanging efficiency of the apparatus.

Another problem with the prior art apparatus is in securing the tubes firmly within the frame. Permanent welds make tube replacement a very difficult process and are vulnerable to fatigue failure. Force fitting permits easier replacement of the tubes on an individual basis and eliminates fatigue failure, but force fitted tubes may loosen through vibration, jarring, or extreme changes in temperature during use of the apparatus.

The extensive and continually expanding field of application for such heat exchange devices has created a strong demand to improve the efficiency, reliability, and ease of assembly and disassembly of the heat exchange apparatus. The present invention achieves improvement in each of those ends.

SUMMARY OF THE INVENTION

It is, therefore, an important object of this invention to provide an effective, inexpensive, versatile, and easily manufactured article for retaining a heat exchange tube within a heat exchange apparatus.

It is also an object of this invention to provide a quickly and easily removable article for retaining a removable heat exchange tube within a heat exchange apparatus.

It is an additional object of the present invention to provide increased efficiency in a heat exchange apparatus which has non-finned portions of the heat exchange tubes exposed to air flowing through the apparatus.

It is another object of this invention to provide a heat resistant and resilient heat exchange tube retainer which will mount on the end of a heat exchange tube within the support member or frame and simultaneously retain the heat exchange tube firmly in place in the apparatus, prevent the escape of air flow between the ends of the heat exchange tubes within the support member, increase the air flow over the finned portion of the heat exchange tubes within the apparatus, and self-maintain its proper positioning on the heat exchange tube in the apparatus.

Further purposes and objects of the present invention will appear as the specification proceeds. They and the foregoing purposes and objects are accomplished by our invention of an improvement for a heat exchange apparatus of the type having a support member and at least one heat exchange tube with two ends and a central portion. The heat exchange tube is secured at each end within the support member and has at least one heat exchange fin attached to, and outwardly extending from, the central portion. Our improvement in the apparatus is the addition of an elongated heat exchange tube retainer having a body and preferably, although not necessarily, at least one protruding member. The body of the retainer attaches to the end of the heat exchange tube between the central portion and the support member and serves to secure the heat exchange tube within the support member and to prevent longitudinal movement of the heat exchange tube within the support member. The protruding member and the body preferably provide for the deflection of air toward the heat exchange fin or fins on the heat exchange tube or tubes.

BRIEF DESCRIPTION OF THE DRAWINGS

In the accompanying drawings, our preferred embodiment of the present invention is illustrated wherein.

DETAILED DESCRIPTION OF THE PREFERRED EMBODIMENT

Figure 1:
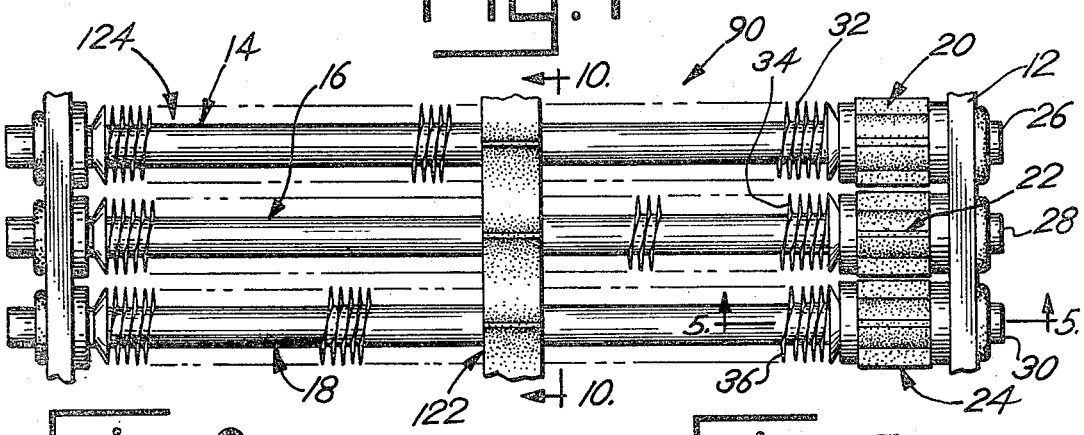
FIG. 1 is a plan view of the relevant portion of one row of heat exchange tubes as mounted within an improved heat exchange apparatus.

With reference to FIG. 1 of the drawings, the relevant portion of a preferred embodiment of the improved heat exchange apparatus, generally 90, is shown as it would be used to cool hot oil generated in the use of industrial machinery, e.g., in hydraulic transmissions (not shown). The relevant portion of the apparatus 90, as illustrated, has several removable, circular heat exchange tubes 14, 16, and 18 secured and arranged in parallel and in a row 124 within a support member 12. Surrounding and attached to a portion of the exterior of each of the heat exchange tubes 14, 16, and 18 is a helical heat exchange fin 32, 34, and 36. Self-biasing heat exchange tube retainers 20, 22, and 24 are mounted on the heat exchange tubes 14, 16, and 18 and serve to hold the heat exchange tubes 14, 16, and 18 firmly in place within the support member 12 and deflect heat exchange air toward the heat exchange fins 32, 34, and 36 on the heat exchange tubes 14, 16, and 18.

Figure 10:
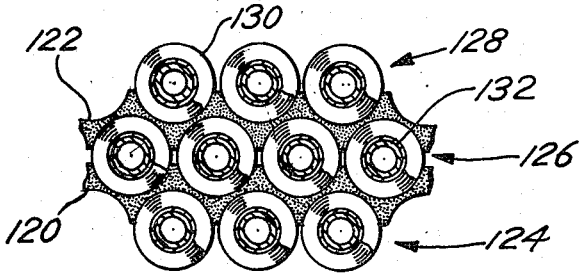
FIG. 10 is a sectional view of the improved heat exchange apparatus taken along section line 10—10 of FIG. 1, revealing the arrangement of several rows of heat exchange tubes within the apparatus. The row of heat exchange tubes shown in FIG. 1 is shown as the bottom row of FIG. 10.

With reference to FIG. 10, the preferred embodiment has several rows of heat exchange tubes 124, 126, and 128. Each row of tubes 124, 126, and 128 is mounted one over the other within the apparatus so that air passing through the heat exchange fins 130 on one row 128 proceeds directly into the body of the tubes 132 in the succeeding row 126. The rows of tubes 124, 126, and 128 are separated from each other by spacers 120 and 122 made of heat resistant, resiliant material.

As noted above, the apparatus 90 is preferably used to cool hot oil generated through the use of industrial machinery such as hydraulic transmissions, and this description is therefore limited accordingly. It is to be understood, however, that application of the improved fluid heat exchange apparatus 90 and the cooling tube retainer 20, 22, and 24 is not limited to use in heat exchange hot oil generated by industrial machinery. The invention may easily be used with other fluids in other fields on other types of heat exchange devices.

For convenience in later reference, right end versus left end distinctions are made with reference to the right and left ends of the apparatus 90 and its component parts as viewed in FIGS. 1, 5, 7, 8, and 9. It is to be understood that the left and right end terminology is only for ease of description and understanding and is not intended to limit the possible spacial orientations of the apparatus 90 or its components during assembly or use.

In the preferred embodiment as shown in FIG. 1, each of the heat exchange tubes 14, 16, and 18 is substantially identical in design as are each of the heat exchange tube retainers 20, 22, and 24. As a result, each heat exchange tube 14, 16, and 18 and each heat exchange tube retainer 20, 22, and 24 is identically mounted and positioned within the support member 12.

Figure 2:
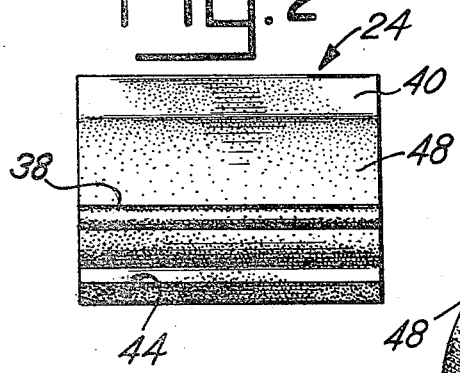
FIG. 2 is a plan view of a heat exchange tube retainer, showing the relative rectangular dimensions of the second protruding member and the thickness of the first protruding member with respect to the body.
Figure 3:
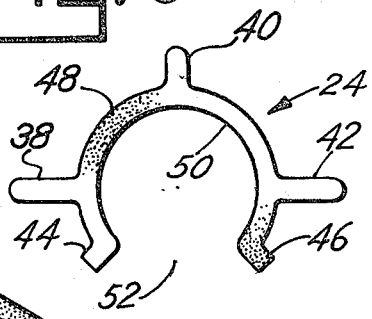
FIG. 3 is another plan view of a heat exchange tube retainer, further showing the location of the channel lips, and the first, second, and third protruding portions on the arcuate body.
Figure 4:
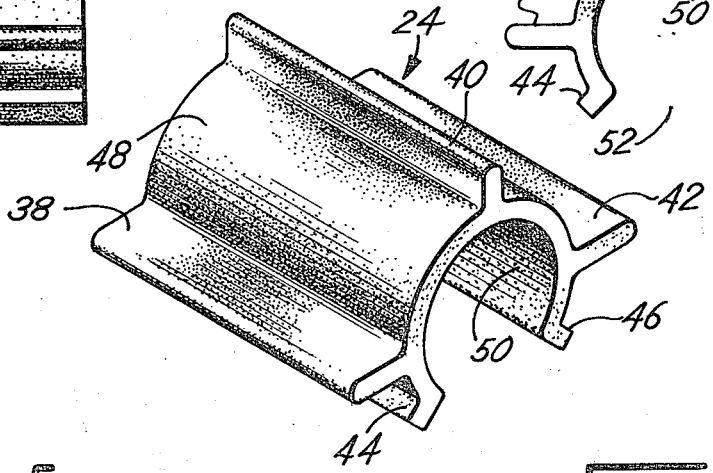
FIG. 4 is a perspective view of a heat exchange tube retainer, depicting the relative dimensions and location of the first, second, and third protruding portions with respect to the arcuate body.

Referring now to FIGS. 2, 3, and 4, a single heat exchange tube retainer 24 is depicted. The retainer 24 has an arcuate body 48 and three planar, rectangular protruding portions 38, 40, and 42 which extend radially from the periphery of the arcuate body 48 along the axial length of the retainer 24. The body 48 has a channel area 52 of uniform width along the axial length of the retainer 24. The first 38 and third 42 protruding portions extend from the body 48 in substantially diametrically opposite directions. The second protruding portion 40 extends from the body 48 diametrically opposite the center of the channel area 52 in the body 48. The plane of the second protruding portion 40 is at right angles to the plane of the substantially coplanar first 38 and third 42 protruding portions.

The radial length of the second 40 protruding portion is long enough to provide a surface that a suitable tool, such as pliers, can grab. The end of the second protruding portion 40 furthest from the arcuate body 48 preferably has a bulbous portion (not shown) on the end thereof to facilitate gripping with the pliers and to make removal of the retainer 24 from the heat exchange tube 18 less difficult.

The radial lengths of the first 38 and third 42 protruding portions are substantially equal and are determined by the spacing of the heat exchange tubes 14, 16, and 18 within the support member 12. The radial edges of each of the protruding portions 38, 40 and 42 are substantially rounded.

A first lip portion 44 and a second lip portion 46 on the arcuate body 48 border the channel area 52 of the retainer 24. The lip portions 44 and 46 extend radially from the body 48 of the retainer 24 but are substantially smaller in radial length than that of the second protruding portion 40.

Figure 5:
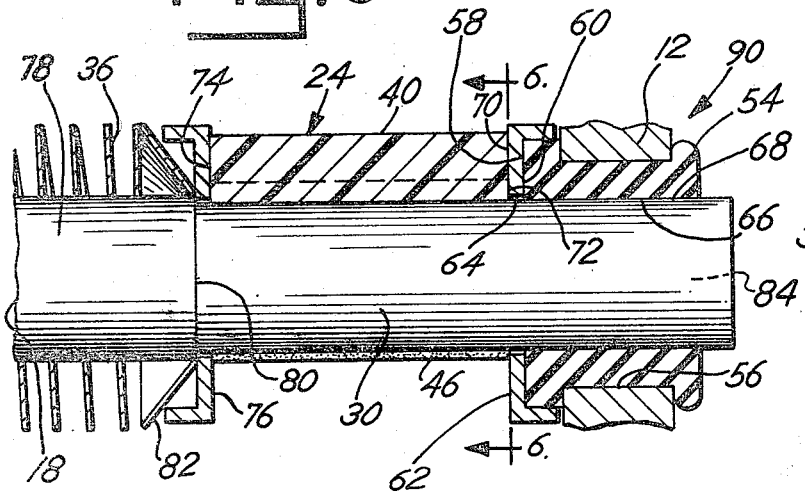
FIG. 5 is a sectional view taken along section line 5—5 of FIG. 1, showing the structure of the improved heat exchange apparatus immediately surrounding the heat exchange tube retainer.

As shown in FIG. 5, when the relevant portion of the preferred embodiment of the apparatus 90 is assembled and used, a grommet 54 having a circular passage 66 is mounted within a circular aperture 56 in the support member 12. Abutting the inner facing 58 of the grommet 54 is the inner surface 60 of a protective cap washer 62. The right end 30 of the cooling tube 18 is mounted within a circular opening 64 in the center of the cap washer 62 and is retained within the passage 66 of the grommet 54 as the surface of the passage 66 in the grommet 54 grips the outside periphery 68 of the right end 30 of the cooling tube 18. The grommet 54 within the aperture 56 thus serves to secure the end 30 of the cooling tube 18 within the support member 12.

The cooling tube retainer 24 is mounted on the right end portion 30 of the cooling tube 18 so that the right end surface 72 of the retainer 24 abuts the outer surface 70 of the cap washer 62. A cap washer 76, also mounted on the right end portion 30 of the cooling tube 18, abuts the left end surface 74 of the cooling tube retainer 24. The diameter of the right end portion 30 of the cooling tube 18 is substantially smaller than the diameter of the central portion 78 of the cooling tube 18, creating a neck 80 between the central portion 78 and the end portion 30. Because the diameter of the central portion 78 is also substantially larger than the internal diameter of the cap washer 76, the neck 80 serves as a stop, preventing contact between the cap washer 76 and the surface of the cooling fin 82 on the central portion 78 of the cooling tube 18.

Figure 6:
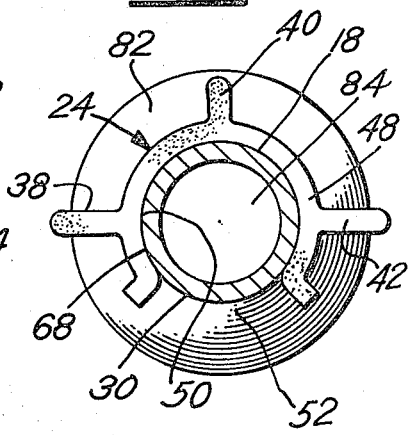
FIG. 6 is a sectional view of the improved heat exchange apparatus taken along section line 6—6 of FIG. 5, further revealing the position of the heat exchange tube retainer when mounted on a heat exchange tube end portion.

As seen in FIG. 3, the width of the channel 52 in the body 48 of the retainer 24 is substantially less than, as seen in FIG. 6, the outside diameter of the right end 30 of the cooling tube 18 upon which the retainer 24 is mounted. The inside diameter of the arcuate body 48, as also seen in FIG. 3, is also slightly less than, as seen in FIG. 6, the outside diameter of right end 30 of the cooling tube 18. Referring again to FIG. 6, the inside surface 50 of the resilient cooling tube retainer 24 thus firmly grips the outer periphery 68 of the end 30 of the cooling tube 18 when mounted thereon.

Referring still to FIG. 6, the second protruding portion 40 of the retainer 24 is aligned perpendicularly to the plane, as shown in FIG. 1, within which the cooling tubes 14, 16, and 18 lie and, as shown in FIG. 6, extends from the arcuate body 48 in the direction from which cooling air will be directed at the apparatus 90 during use. The gripping action of the inside surface 50 of the retainer 24 on the outer periphery 68 of the end 30 of the cooling tube 18 is such that the retainer 24 maintains its original bias on the cooling tube 18 during vibration, jarring, and use of the apparatus 90.

Figure 7:
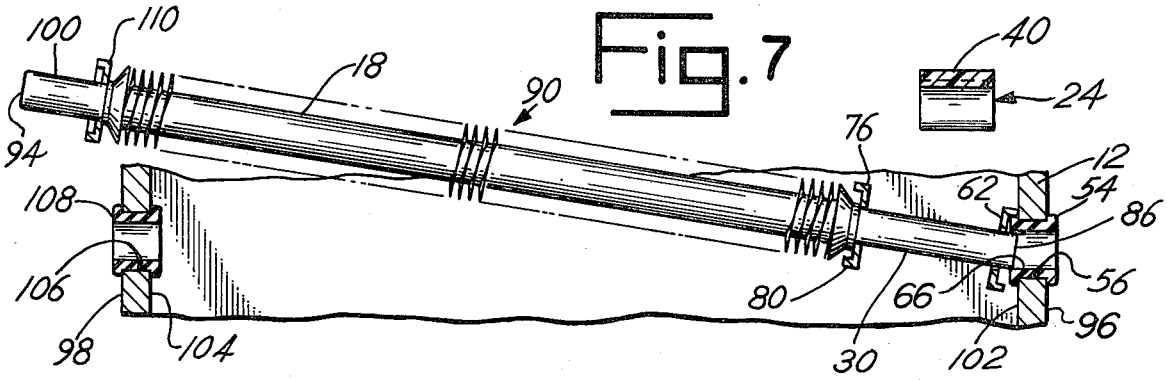
FIG. 7 is a sectional view of a disassembled improved heat exchange apparatus, showing the method of inserting the right end of a heat exchange tube into the support member.
Figure 8:
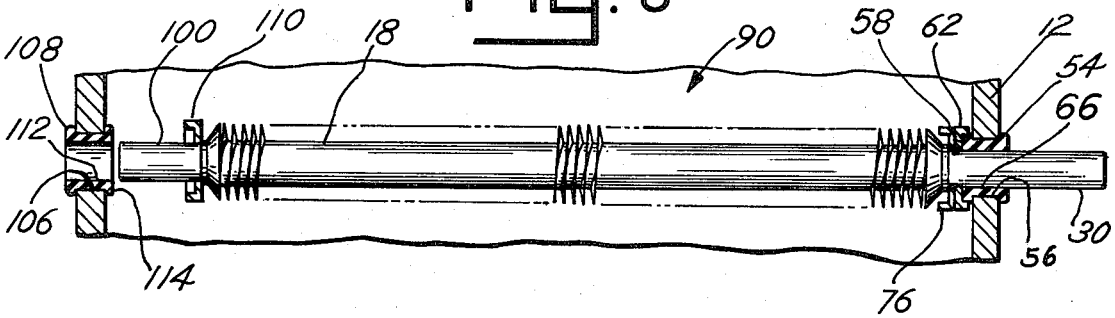
FIG. 8 is another sectional view of a partially assembled improved heat exchange apparatus showing the method of inserting the left end of a heat exchange tube into the support member.
Figure 9:
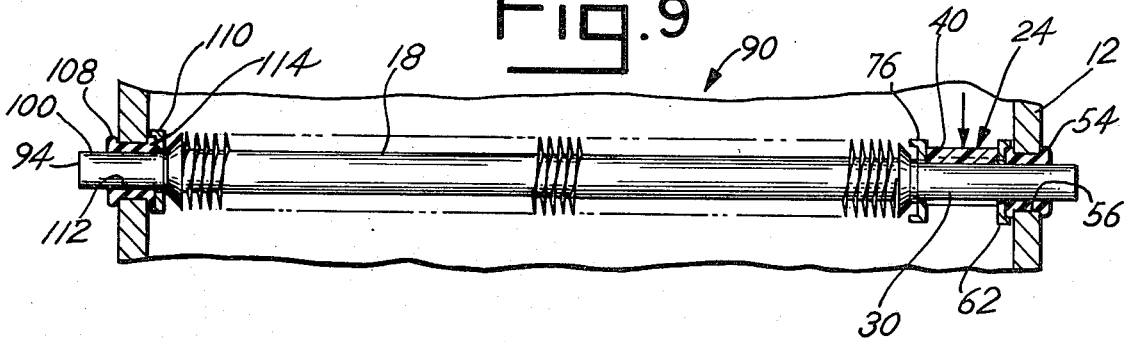
FIG. 9 is an additional sectional view of the improved heat exchange apparatus showing the location of the heat exchange tube retainer on the heat exchange tube when the heat exchange apparatus is completely assembled.

Referring to FIG. 7, the total axial length of the cooling tube 18, from the right end surface 86 to the left end surface 94, is substantially greater than the distance from the right outer wall 96 to the left outer wall 98 of the support member 12. As shown in FIGS. 7, 8, and 9, the axial length of the left end 100 is substantially shorter than the axial length of the right end 30 of the cooling tube 18. Referring to FIG. 7, the axial length of the cooling tube 18 from the neck 80 on the right end 30 to the left end surface 94 is substantially shorter than the distance between the left inner wall 104 and the right inner wall 102 of the support member 12.

Referring again to FIG. 8, the diameter of the left end 100 of the cooling tube 18 is substantially the same as the diameter of the right end 30 of the tube 18. Similarly, the dimensions of the left aperture 106 in the support member 12, the left grommet 108, and the left protective cap washer 110 are also substantially the same as the respective dimensions of the right aperture 56 in the support member 12, the right grommet 54, and the right protective cap washer 62.

With reference to FIGS. 7, 8, and 9, there are essentially four steps in the insertion or removal of the removable cooling tube 18 and retainer 24. The following explanation details the assembly. Disassembly is achieved by simply reversing the process explained.

Referring now to FIG. 7, prior to insertion of the removable cooling tube 18 into the support member 12, the flat washer 76 and the right protective cap washer 62 are positioned on the right end 30 of the cooling tube 18. The left protective cap washer 110 is positioned on the left end 100 of the tube 18. The left 108 and right 54 grommets are inserted into their respective apertures 106 and 56 in the support member 12. The right end 30 of the cooling tube 18 is then positioned in the passage 66 in the right grommet 54.

Referring to FIG. 8, the right end 30 of the cooling tube 18 is forcibly inserted into the passage 66 in the right grommet 54 as far as it will go into the grommet passage 64, forcing the right protective cap washer 62 to seat over the inner facing 58 of the right grommet 54. The left end 100 of the cooling tube 18 is then aligned with the passage 112 in the left grommet 108.

As shown in FIG. 9, the final steps in assembly of the apparatus 90 occur as the left end 100 of the cooling tube 18 is forcibly inserted into the passage 112 of the left grommet 108. The left end 100 is inserted into the passage 112 as far as it will go, forcing the left protective cap washer 110 to seat over the inner facing 114 of the left grommet 108. The cooling tube retainer 24 is then mounted on the right end 30 of the cooling tube 18 between the left cap washer 76 and the right cap washer 62. Mounting and aligning of the cooling tube retainer 24 on the cooling tube 18 is facilitated by grasping the second protruding portion 40 with the thumb and forefinger.

When the apparatus 90 is completely assembled, as shown in FIG. 1, the removable cooling tubes 14, 16, and 18 are firmly held in place within the apparatus 90 by the cooling tube retainers 20, 22, and 24. The retainers 20, 22, and 24 self-maintain bias on the cooling tubes 14, 16, and 18 to prevent the escape of cooling air past the right ends 26, 28, and 30 of the cooling tubes 14, 16, and 18 on which the retainers 20, 22, and 24 are mounted. In addition, the cooling tube retainers 20, 22, and 24 deflect air toward the cooling fins 32, 34, and 36 on the cooling tubes 14, 16, and 18 in the apparatus 90. As shown for one of the retainers 24 in FIG. 9, the protective cap washers 62 and 110 protect the grommets 54 and 108 from being damaged as a result of any force exerted on the grommets 54 and 108 by the retainer 24 through vibration or jarring of the apparatus 90 during assembly or use.

Referring to FIG. 6, the hot fluid to be cooled by the improved apparatus flows through the inside 84 of the cooling tube 18. Referring to FIG. 5, the helical cooling fin 36 attached to and surrounding the periphery of the central portion 78 of the cooling tube 18 serves to remove heat from the hot fluid flowing through the inside 84 of the cooling tube 18 when cooling air passes over the cooling fin 36. In the preferred embodiment, referring now to FIG. 6, the flow of cooling air is directed perpendicularly to the planes of the first 38 and third 42 protruding portions from the side of the apparatus on which the second protruding portion 40 is located.

In the preferred embodiment as seen in FIGS. 1, 7, 8, and 9, the cooling tube retainer 24 is made of a heat and fluid resistant material, such as glass-filled nylon, that is resilient at both normal atmospheric and elevated working temperatures. Particularly preferred materials of constructions are glass filled nylon materials sold by DuPont under the trade designation Zytel 70 G-33. The cap washers 62, 76, and 110 are made of heat and fluid resistant material that is also resilient at normal atmospheric and elevated working temperatures, such as a glass-filled nylon. All other components are made of heat and fluid resistant aluminum alloys or steels.

While in the foregoing, there has been provided a detailed description of one particular embodiment of the present invention, it is to be understood that all equivalents obvious to those skilled in the art are to be included within the scope of the invention as claimed.

What I claim and desire to secure by Letters Patent is:

1. In a heat exchange apparatus of the type having a support member, at least one heat exchange tube having two ends and a central portion, and means for securing the tube at each of its ends within the support member, said heat exchange tube having at least one heat exchange fin means attached to the outer periphery of the central portion and outwardly extending therefrom, the improvement comprising:

an elongated heat exchange tube retainer having an internal cross-section and an axial length, said cross-section defining means for attaching to one end of said heat exchange tube along the entire axial length of said retainer, the elongated tube retainer being mounted on an end of said heat exchange tube to provide means for securing the heat exchange tube within the support member and being of sufficient length to prevent longitudinal movement of the heat exchange tube within the support member.

2. The apparatus of claim 1 wherein said heat exchange tube retainer has a body and at least one protruding portion, said body having an internal cross-section defining means for removably attaching to one end of said heat exchange tube and said protruding portion defining means for the deflection of air towards said heat exchange fin means.

3. The apparatus of claim 1 wherein said heat exchange tube retainer also has a middle protruding portion providing means for grasping and positioning said retainer when mounting said retainer on said tube or removing said retainer from said tube.

4. The apparatus of claim 1 wherein said heat exchange tube retainer has first and second protruding portions extending in substantially opposite directions from the periphery of said arcuate body and providing a surface for the deflection of air towards the heat exchange fin means.

5. The apparatus of claim 4 wherein said heat exchange tube retainer also has a planar middle protruding portion located on said arcuate body between said first and second protruding portions and providing means for grasping and positioning said retainer when mounting said retainer on said heat exchange tube or removing said retainer from said tube.

6. The apparatus of claim 5 wherein said heat exchange tube retainer also provides means for maintaining bias on said end of said heat exchange tube.

7. The apparatus of claim 1 wherein said heat exchange tube retainer has an arcuate body with a channel of substantially uniform width providing means for removably mounting said arcuate body on said end of said heat exchange tube.

8. In a heat exchange apparatus of the type having a support member, at least one heat exchange tube having two ends and a central portion, and means for securing the tube at each of its ends within the support member, said heat exchange tube having at least one heat exchange fin means attached to the outer periphery of the central portion and outwardly extending therefrom, the improvement comprising:

an elongated heat exchange tube retainer having an internal cross-section defining means for attaching to one end of said heat exchange tube, the elongated tube retainer being mounted on an end of said heat exchange tube to provide means for securing the heat exchange tube within the support member and being of sufficient length to prevent longitudinal movement of the heat exchange tube within the support member; said heat exchange tube retainer having an arcuate body with a channel of substantially uniform width providing means for removably mounting said arcuate body on said end of said heat exchange tube.

9. The apparatus of claim 8 wherein said heat exchange tube retainer also has a middle protruding portion providing means for grasping and positioning said retainer when mounting said retainer on said tube or removing said retainer from said tube.

10. The apparatus of claim 8 wherein said heat exchange tube retainer also has at least one protruding portion extending outwardly from the periphery of said arcuate body and defining means for the deflection of air towards said heat exchange fin means.

11. The apparatus of claim 8 wherein said heat exchange tube retainer has first and second protruding portions extending in substantially opposite directions from the periphery of said arcuate body and providing a surface for the deflection of air towards the heat exchange fin means.

12. The apparatus of claim 11 wherein said heat exchange tube retainer also provides means for maintaining bias on said end of said heat exchange tube.

13. The apparatus of claim 12 wherein said heat exchange tube retainer also has a middle protruding portion located on said arcuate body between said first and second protruding portions and providing means for grasping and positioning said retainer when mounting said retainer on said tube or removing said retainer from said tube.

14. The apparatus of claim 13 wherein said arcuate body has a first and a second lip bordering said channel, said first and second lips providing means for engaging the outer periphery of said end portion on said heat exchange tube when mounting said heat exchange tube retainer on said heat exchange tube.

15. In a heat exchange apparatus of the type having a support member, at least one removable heat exchange tube having two ends and a central portion, and means for securing the tube at each of the ends within the support member, said heat exchange tube being circular in cross-section and having at least one heat exchange fin means attached to the outer periphery of the central portion and extending outwardly therefrom, the improvement comprising:

a removable heat exchange tube retainer made of resilient, heat resistant material and having an arcuate body, a first, a second, and a third planar protruding portion, and a first and a second lip portion, said arcuate body having a circular internal cross-section and an axial channel of substantially uniform width, said internal cross-section having an internal diameter slightly less than the outer diameter of a heat exchange tube end portion, said first, second, and third protruding portions, and said first and second portions extending radially along the axial length of said arcuate body, said second protruding portion being located on said arcuate body substantially midway between said first and second protruding portions and diametrically opposite the center of said axial channel, said first and second lip portions bordering said channel to provide means for engaging the outer periphery of said end portion on said heat exchange tube when mounting said tube retainer on said tube, said heat exchange retainer being mounted on an end of said heat exchange tube to secure the heat exchange tube within the support member and deflect air towards said heat exchange fin means on said heat exchange tube.

16. In a heat exchange apparatus of the type having a support member, at least one heat exchange tube with two ends and a central portion, and means for securing the tube at each of the ends to the support member, said heat exchange tube having at least one heat exchange fin means attached to the outer periphery of the central portion and outwardly extending therefrom, said securing means including an aperture passing through the support member and a grommet mounted within the aperture, said grommet being comprised of pliable, heat resistant material and having a middle section passing through the aperture, an inner facing section extending substantially beyond the aperture within the inside perimeter of the support member, an outer facing section extending substantially beyond the outer perimeter of the support member, and an internal passage extending through the middle and facing sections, said passage in the grommet defining means for firmly retaining the end of the heat exchange tube, the improvement comprising, in combination:

an elongated heat exchange tube retainer having an internal cross-section defining means for attaching to one end of said heat exchange tube, the retainer being mounted on an end of said heat exchange tube to provide means for securing the heat exchange tube within the support member and being of sufficient length to prevent longitudinal movement of the heat exchange tube within the support member;

a protective cap washer having a cap and a flat portion with an opening therein, said opening having a cross-section defining means for mounting said cap washer on the end of the heat exchange tube between the heat exchange tube retainer and the grommet and said cap on the cap washer defining means for covering and protecting the inner facing section of the grommet.

17. The apparatus of claim 16 wherein said heat exchange tube retainer also has a middle protruding portion providing means for grasping and positioning said retainer on said tube or removing said retainer from said tube.

18. The apparatus of claim 16 or 17 wherein said heat exchange tube retainer also has first and second protruding portions extending in substantially opposite directions from the periphery of said arcuate body and providing a surface for the deflection of air towards the heat exchange fin means.

19. The apparatus of claim 16 wherein said heat exchange tube retainer also has at least one protruding portion extending outwardly from the periphery of said arcuate body and defining means for the deflection of air towards said heat exchange fin means.

20. The apparatus of claim 16 or 19 wherein said heat exchange tube retainer has an arcuate body with a channel of substantially uniform width providing means for removably mounting said arcuate body on said end of said heat exchange tube.

21. The apparatus of claim 16 wherein the improvement further comprises a second protective cap washer also having a cap and a flat portion with an opening therein, said opening in said second cap washer defining means for mounting said second cap washer on the end of the heat exchange tube opposite the end on which the retainer is mounted and between said heat exchange tube central portion and the grommet on said opposite end and said cap on said second cap washer defining means for covering and protecting the inner facing of the grommet on said opposite end.

* * * * *